US005288362A

United States Patent [19]

Shuh-Chin

[11] Patent Number: 5,288,362

[45] Date of Patent: Feb. 22, 1994

[54] TAPE DISPENSER OF PACKAGING

[76] Inventor: Lin Shuh-Chin, No. 36, Lane 13, Ji-Syang St., Hsinten City, Taipei, Taiwan

[21] Appl. No.: 5,045

[22] Filed: Jan. 15, 1993

[51] Int. Cl.[5] ..... B32B 31/00

[52] U.S. Cl. ..... 156/523; 156/526; 156/579

[58] Field of Search ..... 156/523, 526, 530, 525, 156/577, 579

[56] References Cited

U.S. PATENT DOCUMENTS

| | | | |
|---|---|---|---|
| 4,097,328 | 6/1978 | Urushizaki | 156/523 |
| 4,238,271 | 12/1980 | Urushizaki | 156/523 |
| 4,486,263 | 12/1984 | Monzo Gomez | 156/523 |

*Primary Examiner*—David A. Simmons
*Assistant Examiner*—James J. Engel, Jr.
*Attorney, Agent, or Firm*—Morton J. Rosenberg; David I. Klein

[57] ABSTRACT

This invention directs itself to a tape dispenser system which includes a housing (1, 1') having an enclosure. A pressure plate (121) contiguously interfaces with a tape (4) to displace the pressure plate (121) into contact with a swing block (17). The swing block (17) is rotatively actuated with respect to the housing (1, 1') and drives a cutter holder (18) and cutter blade (181) combination into engagement with the tape (4) for severing the tape (4). The cutter blade holder (18) is coupled to a second end of the swing block (17) within an elongated slot (172) for transferring the rotative motion of the swing block (17) into a linear drive displacement for the cutter blade (181). A stop member (175) having wing member (176, 177, and 178) are rotatably mounted to the housing (1, 1') for contacting an end of the swing block (17) and releasing such for rotation to drive the cutter blade (181) external the housing (1, 1').

1 Claim, 6 Drawing Sheets

TAPE DISPENSER OF PACKAGING

BACKGROUND OF THE INVENTION

1. Field of the Invention

This invention relates to a packaging tape dispenser system. In particular, this invention directs itself to a tape dispenser system which includes a cutting mechanism having a displaceable push plate for rotatably actuating a swing block which in turn actuates a cutter holder and a cutter blade. A rotary tape holder seat and a swing base for a guide plate are pivotally connected within a housing formed of an upper housing and a lower housing which facilitates loading of tape and maintaining the tape in a relatively clean environment.

2. Prior Art

A prior art system is shown in FIG 1 and includes a casing A supported on a handle F to hold a socket B and a roller G for mounting and leading a packaging tape C. A toothed cutter H is located above the roller G for cutting and pressing down the leading end D of the packaging tape C. The prior art system as shown has a number of disadvantages including:

1. The toothed cutter is fixedly mounted in a position exposed to the exterior of the housing, which may injure the operator's hand during a packing operation;

2. The leading end of the packaging tape passes the leading roller E during operation which reduces the adhesive strength of the tape; and, 3. The leading end of the packaging tape may be contaminated with dust since it is exposed to the external environment which has the effect of reducing the tape adhesive strength.

SUMMARY OF THE INVENTION

This invention provides for a tape dispenser system which includes a swing block having opposing ends. A pressure plate and a cutter holder are in contact with the swing block for actuation of the entire system. In operation, the tape is applied to a package seal and the tape dispenser is moved along the seal. The tape is pulled out around a roller. As the packaging is completed the tape dispenser is pushed toward the package in order to displace the pressure plate into engagement with the swing block which then engages the cutter holder/cutter blade combination to displace such and cut the tape. A pair of lugs are located in the upper and lower housing of the system. A swing base for a guide plate and a rotary tape holder seat are located in the housing. During loading or removal of tape, the swing base is rotated out of the upper and lower housing. As loading or removal is completed, the swing base is moved to its original closed position and the base is fastened by insertion of hooks into a gap formed in the upper and lower housing. The hooks are mounted respectively on upper and lower edges of the guide plate. In this way the cover does not have to be removed and the tape is protected from the external environment.

DESCRIPTION OF THE PREFERRED EMBODIMENTS

Figure 1:
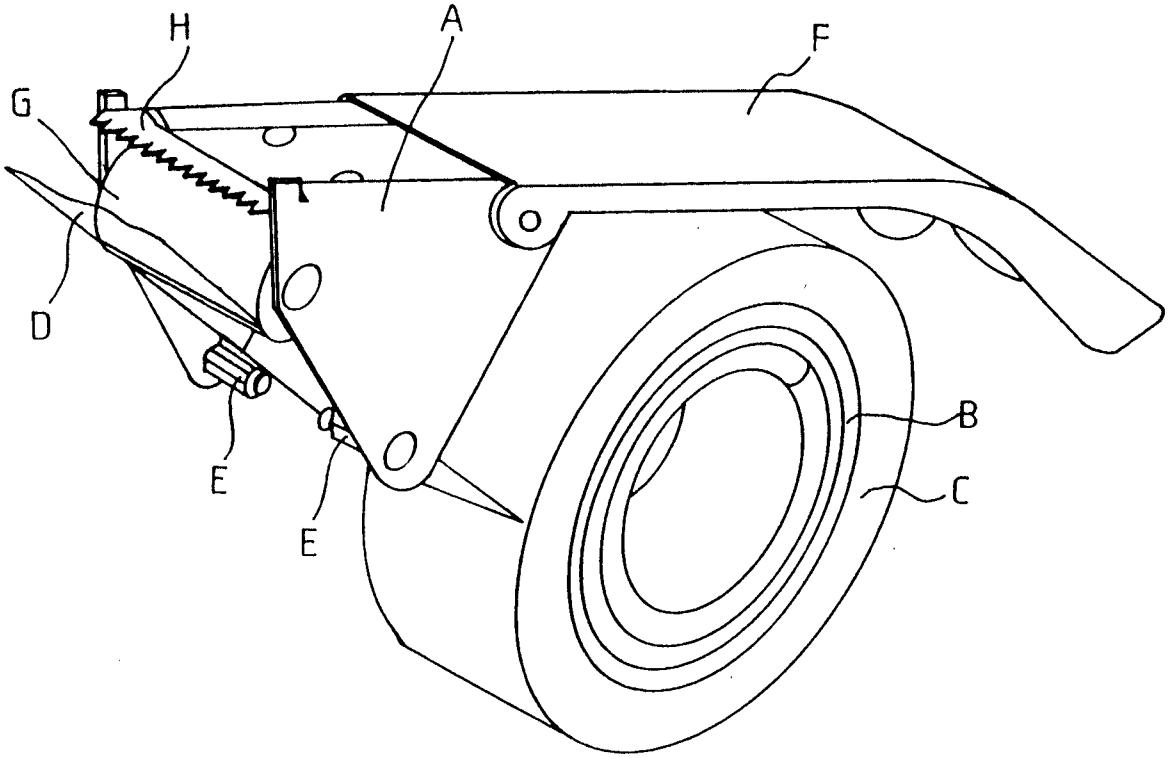
FIG 1 (PRIOR ART)
FIG. 1 is a perspective view of a prior art tape dispenser.
Figure 2:
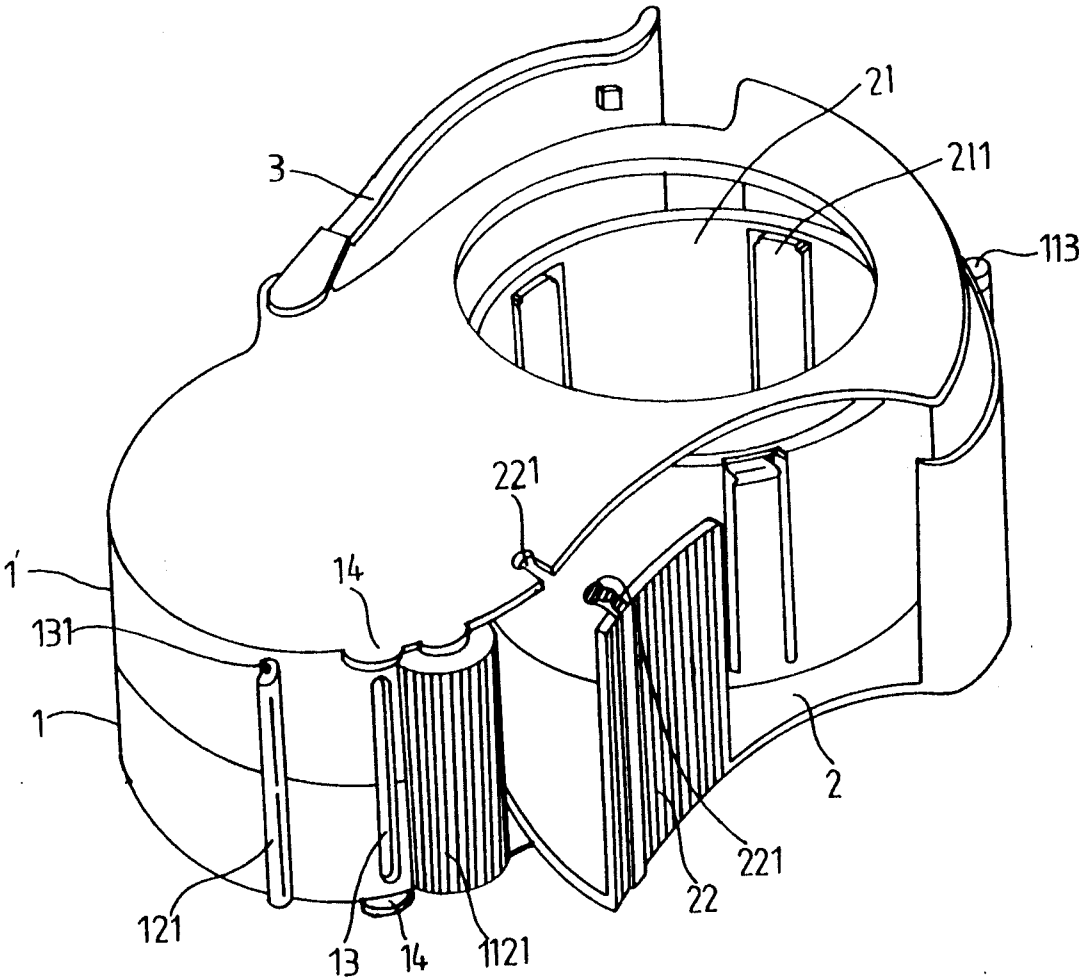
FIG. 2 is a perspective view of the tape dispenser system of the subject invention concept.
Figure 3:
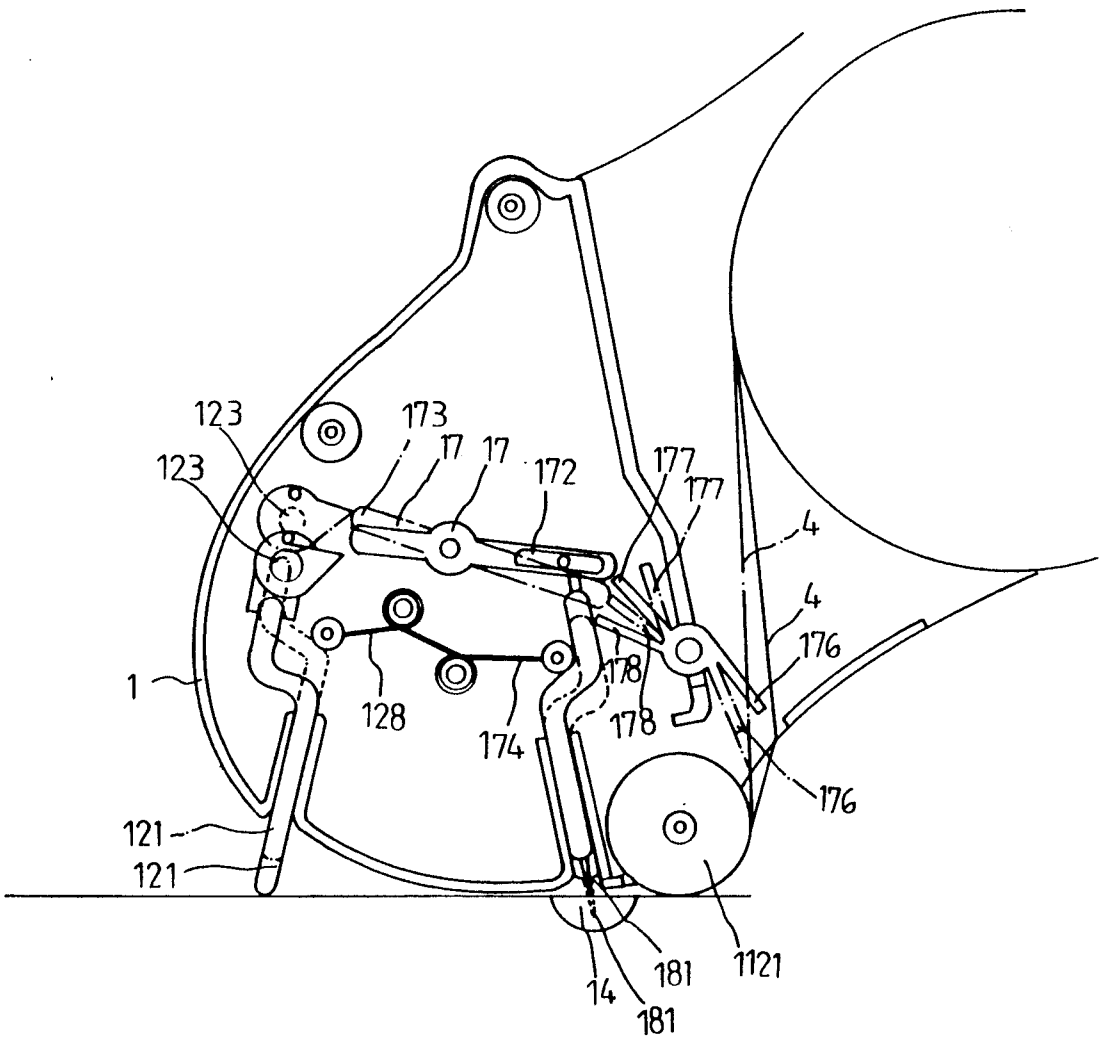
FIG. 3 is an exploded perspective view of the subject tape dispenser system.
Figure 4:
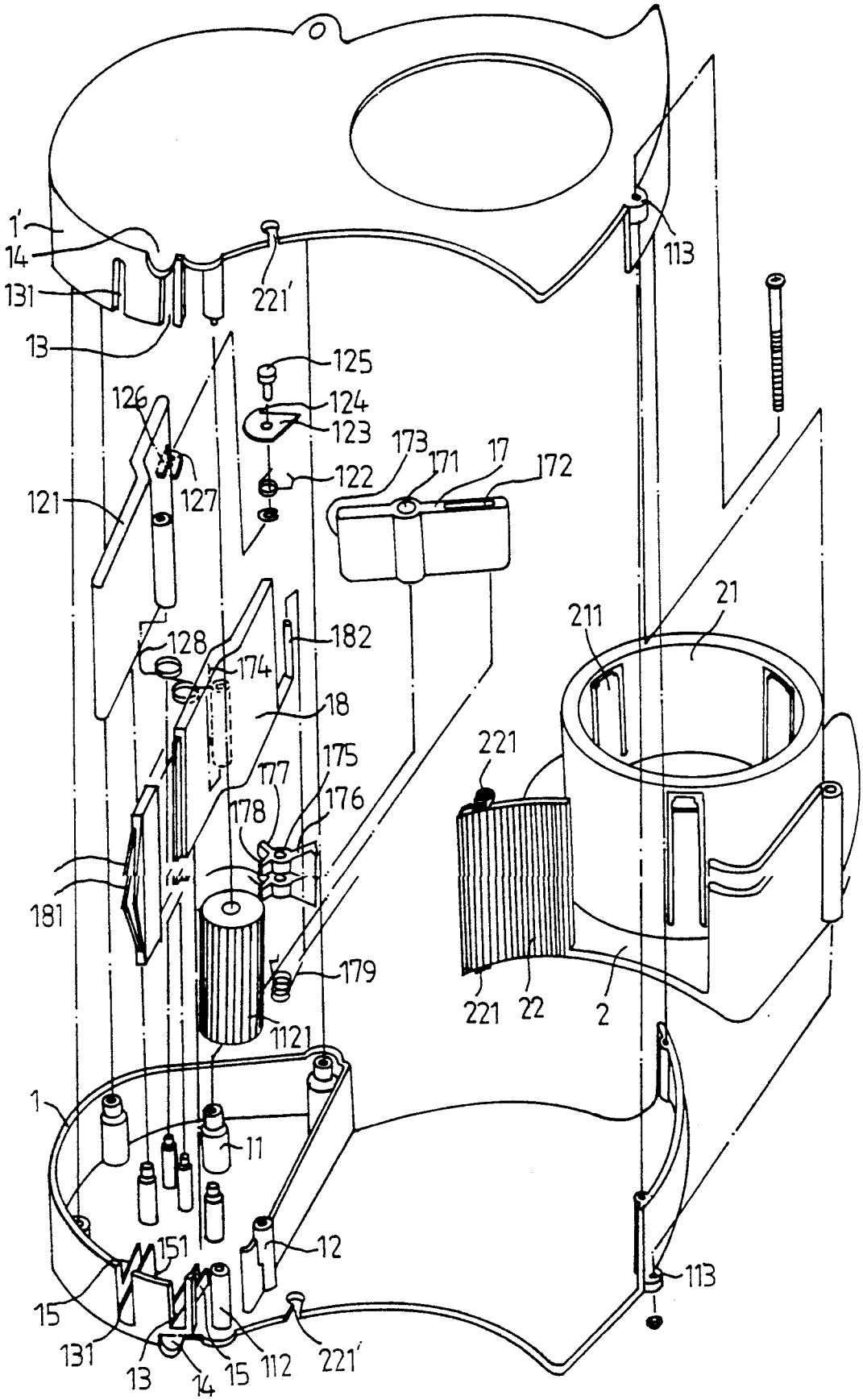
FIG. 4 is an exploded perspective view of the instant tape dispenser system.
Figure 5:
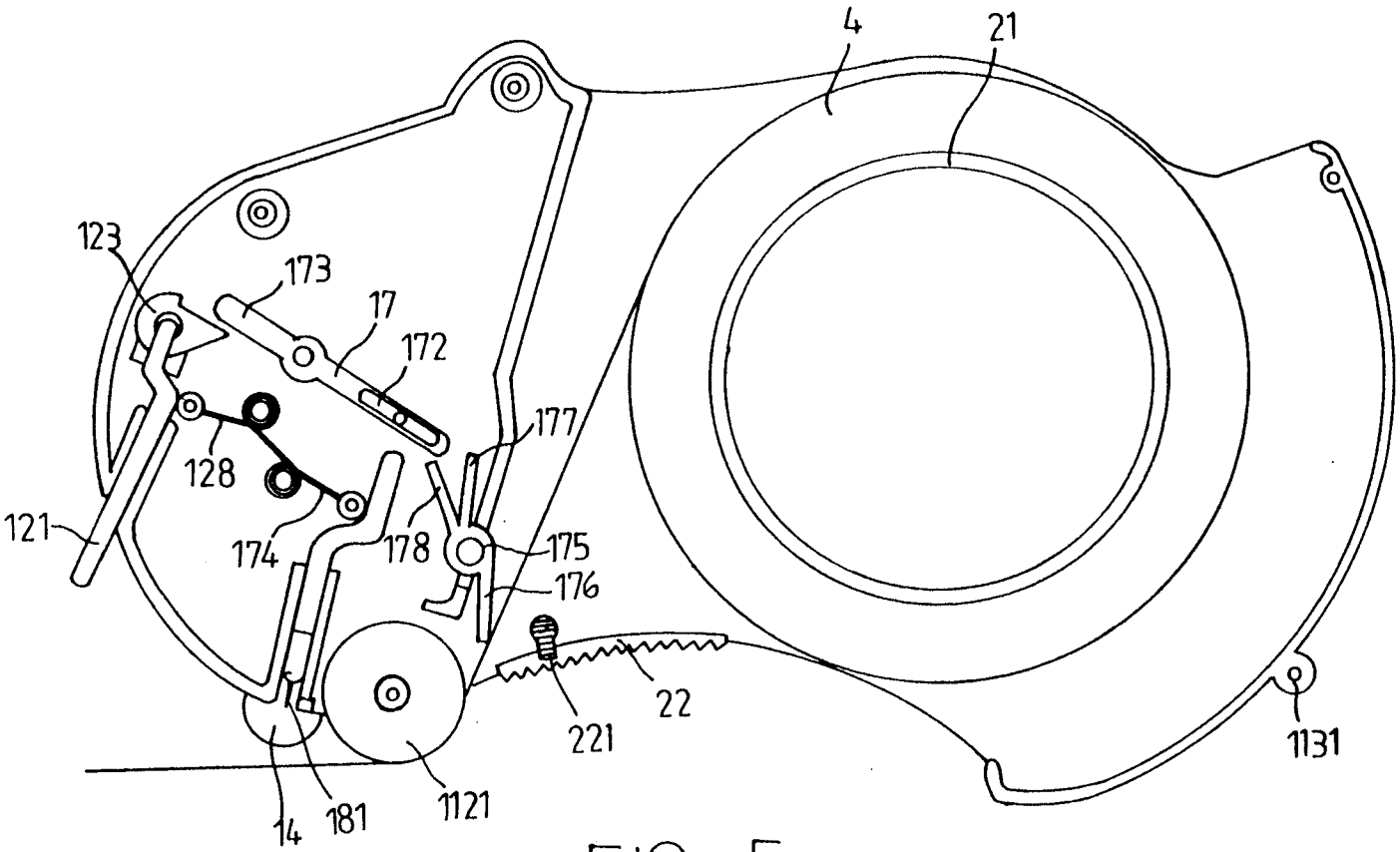
FIG. 5 is a cross-sectional elevation view showing the internal structure of the instant tape dispenser system; and, FIG. 6 is a perspective view of the instant tape dispenser system being loaded into the housing.
Figure 6:
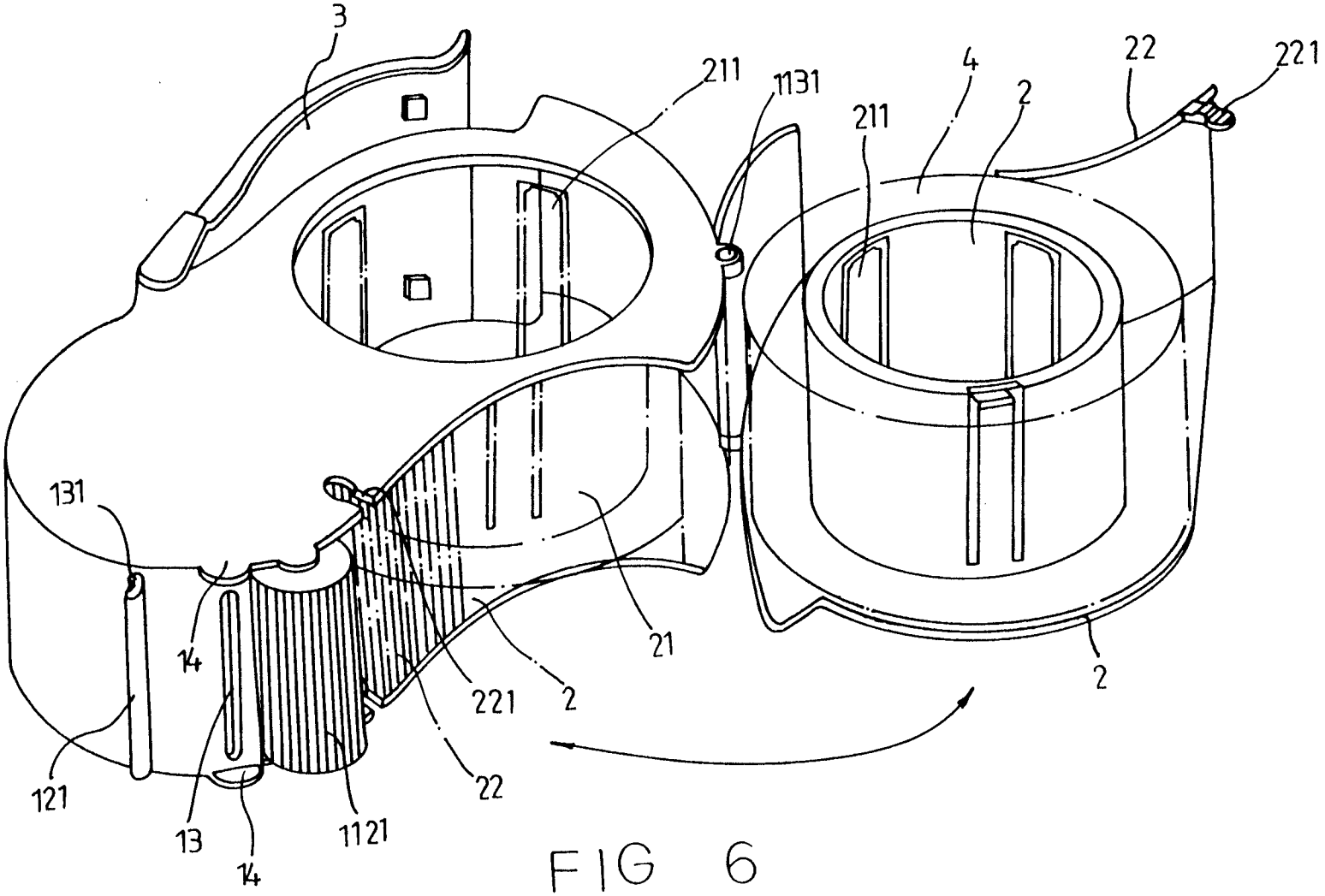

Referring now to FIGS. 2, 3, 4 and 5, the subject invention concept tape dispenser system includes a pressure plate 121, a rotatable swing block 17 and a cutter holder 18 with a cutter blade 181 formed thereon. The combination of the cutter holder 18/cutter blade 181 forms a cutting mechanism displaceably mounted to the upper and lower housing 1, 1'. A pressure plate outlet hole or opening 131 and a cutter blade outlet hole or opening 13 are separately located at a front section of the upper and lower housing 1, 1' and extend inwardly to form a sliding way or passage 151 having a rib member 15. The pressure plate 121 cooperates with the cutter holder 18 within the sliding way 151 to allow a sliding displacement therein. An axle hole 171 is located above the center of swing block 17 and cooperates with post 11 in order to allow rotatable displacement. An elongated slot 172 is formed through the swing block 17 as shown and is responsively displaced by side post 182 inserted therein. A fastening element 125 located behind the pressure plate 121 is insertable through a lug 127 of push plate 123. Push plate 123 has a notch 124 on the peripheral edge thereof terminating in a pin 126 of lug 127. Push plate 123 is thus confined to reversibly rotate in one plane. Spring 122 is mounted on push plate 123 for stabilizing the push plate 123 when there is no external force applied. When the pressure plate 121 is contiguously forced against a carton box during a packaging operation, it is displaced internal housing 1, 1' causing the push plate 123 to bear against and responsively displace the swing block 17. When the swing block 17 is rotated in one direction by the push plate 123, the cutter holder 18 is simultaneously displaced and the cutter blade 181 is displaced through the cutter blade outlet hole 13. Once the cutter blade 181 is moved through the cutter blade outlet hole 13, the packaging tape 4 is severed at a desired length. The overall contour of the cutter blade 18 may be variously embodied. When the cutter blade 181 has been displaced external cutter blade outlet hole 13, the packaging tape 4 is cut or severed and the opposite end edge 173 of the swing block 17 is displaced from the push plate 123 of the pressure plate 121. Immediately thereafter, the swing block 17 is forced by a biasing spring 174 to move back to its original position, causing the cutter holder 18 to be displaced into the housing 1, 1'. The pressure plate 121 is moved back to its original position by the spring 128. Simultaneously, the push plate 123 is displaced by the spring 122 over the opposite end edge 173 of the swing block 17 and returns to its original position. Two lugs 113 and 113' are respectively in the upper and lower housing 1 and 1' for rotation of a swing base 2 having a guide plate 22 as well as a seat of rotary tape holder 21. The swing base 2 may be pulled out to facilitate loading of tape 4. Fastening springs 211 are formed in the tape holder 121 in order to fix tape 4 thereon. Two hooks 221 are respectively on the upper and lower edges of guide plate 22 which are insertable in respective holes 221' which are formed in the upper and lower housing 1, 1' respectively in order to fasten the swing base 2 thereto. Stop member 175 includes first wing 176, second wings 177, and third wing 178 and are displaced through the recovery force of spring 179 wherein the first wing 176 located above the tape 4 makes the second wing point or direct itself to the lower part of the swing block 17 to keep the cutter blade holder 18 from being displaced downwardly when it is not in operation. When the packaging tape 4 is pulled out, the first wing 176 of the stop member 175 is rotated inwardly, causing the second wing 177 to disconnect from the swing block 17 and the swing block 17 is then released from the stop member 175 for performing a cutting operation. When the swing block 17 has been moved to its limit rotation, the third wing 178 of the stop member 175 is simultaneously rotated, causing the second wing 177 to move back to its original position against the swing block 17.

I claim:

1. A packaging tape dispenser system for delivering and cutting tape comprising:

(a) a housing forming a tape enclosure;

(b) a swing base member rotatably mounted to said housing for insert and removal of said tape from said enclosure;

(c) a pressure plate member slideably mounted to said housing and linearly displaceable responsive to impingement with said tape, said pressure plate member extending through a pressure plate opening formed through a wall of said housing;

(d) a cutter blade holder mounted to said housing member and displaceable responsive to a displacement of said pressure plate member, said cutter blade holder having a cutter blade formed thereon for displacement external said housing member through a blade outlet opening formed through said wall of said housing for cutting said tape responsive to said displacement of said pressure plate member;

(e) a swing block member rotatably coupled to said housing member between said pressure plate member and said cutter blade holder, said swing block member having opposing first and second end sections rotatable about a central pivot, said first and second end sections being rotatably displaceable responsive to contact with said pressure plate member, said second end section having a slot formed therethrough for insert of a side post member coupled to said cutter blade holder for reversible linear displacement of said cutter blade responsive to rotative displacement of said swing block member; and, (f) a stop member rotatably coupled to said housing, said stop member having first, second and third wing extension lugs, said first wing extension lug being rotatably actuated by interface with said tape, said second wing extension lug being displaced from contact with said second end section of said swing block member responsive to said rotation of said first wing extension lug providing rotation of said swing block member until contacted by said third wing extension lug thereby terminating displacement of said cutter blade holder.

* * * * *